United States Patent [19]

Kushnick et al.

[11] Patent Number: 4,529,458

[45] **Date of Patent: * Jul. 16, 1985**

[54] COMPACTED AMORPHOUS RIBBON

[75] Inventors: Julian H. Kushnick, Brooklyn, N.Y.; Dulari L. Sawhney, Denville; Robert E. Hathaway, Dover, both of N.J.

[73] Assignee: Allied Corporation, Morris Township, Morris County, N.J.

[ * ] Notice: The portion of the term of this patent subsequent to Jul. 16, 2002 has been disclaimed.

[21] Appl. No.: 399,398

[22] Filed: Jul. 19, 1982

[51] Int. Cl.[3] ..... B22F 3/00

[52] U.S. Cl. ..... 148/403; 228/190; 228/235; 148/31.55

[58] Field of Search ..... 228/234, 235, 190, 186; 336/218; 148/31.55, 403, 108

[56] References Cited

U.S. PATENT DOCUMENTS

| | | | |
|---|---|---|---|
| 3,748,721 | 7/1973 | Alexander | 228/190 X |
| 4,053,333 | 10/1977 | Egami et al. | 148/120 |
| 4,056,411 | 11/1977 | Chen et al. | 148/121 |
| 4,142,571 | 3/1979 | Narasimhan | 164/88 |
| 4,197,146 | 4/1980 | Frischmann | 148/108 |
| 4,201,837 | 5/1980 | Lupinski | 148/31.55 |
| 4,202,196 | 5/1980 | Asai et al. | 29/605 X |
| 4,298,382 | 11/1981 | Stempin et al. | 75/202 |
| 4,298,409 | 11/1981 | DeCristofaro et al. | 148/108 |
| 4,364,020 | 12/1982 | Lin et al. | 336/212 |
| 4,368,447 | 1/1983 | Inomata et al. | 336/20 |
| 4,377,622 | 3/1983 | Lieberman | 428/605 |
| 4,381,197 | 4/1983 | Liebermann | 419/24 |

FOREIGN PATENT DOCUMENTS

| | | |
|---|---|---|
| 20937 | 1/1981 | European Pat. Off. . |
| 74640 | 3/1983 | European Pat. Off. . |

OTHER PUBLICATIONS

H. H. Liebermann, "Warm-Consolidation of Glassy Alloy Ribbons," Conference on Rapid Solidification Processing, General Electric Company, Schenectady (New York).

Final Report under Contract DE-4C01-78E r 9313, "Development of a Low Loss Magnetic Composite Utilizing Amorphous Metal Flake".

*Primary Examiner*—L. Dewayne Rutledge

*Assistant Examiner*—Debbie Yee

*Attorney, Agent, or Firm*—James Riesenfeld; Gerhard H. Fuchs; Michael J. Weins

[57] ABSTRACT

This invention relates to the production of large shapes of metallic glass fabricated from ribbon. The inventive method contemplates placing the ribbon and consolidating the alloy under a pressure or at least 1000 psi at a temperature of between 70% and 90% of the crystallization temperature for a time sufficient to facilitate bonding of the ribbons.

8 Claims, No Drawings

COMPACTED AMORPHOUS RIBBON

FIELD OF INVENTION

The present invention relates to a method for compacting metallic glass ribbon.

BACKGROUND OF THE INVENTION

Metallic glasses have developed from a state of scientific curiosity to industrial products such as brazing foils and magnetic flux conductors. Ferromagnetic metallic glasses have received much attention because of their exceptional ferromagnetic properties.

One limitation of metallic glasses is that the largest shapes that can be produced are thin ribbons. Ferromagnetic metallic glass materials exhibit unusually good magnetic properties; however, when bulk objects are formed by stacking the thin ribbons the thinness of the ribbons causes a low stacking efficiency which in turn causes a low apparent density. For magnetic applications this loss of apparent density results in an increase in volume of stacked ribbon that must be used to give the metallic glass properties comparable to conventional bulk products. In addition the thinness and flexibility of the metallic glass ribbons makes handling of products formed from stacked ribbons difficult.

The problem of forming bulk objects from thin amorphous ribbons has in part been overcome by U.S. Pat. No. 4,298,382 which teaches and claims placing finely dimensioned bodies in touching relationship with each other and then hot pressing with an applied force of at least 1000 psi (6895 kPa) in a non-oxidizing environment at temperatures ranging from about 25° C. below the glass transition temperature to about 15° C. above the glass transition temperature for a period of time sufficient to cause the bodies to flow and fuse together into an integral unit.

H. H. Liebermann in an article entitled "Warm-consolidation of Glassy Alloy Ribbon" points out that significant amounts of shear are required between adjacent ribbon for successful consolidation of amorphous materials.

The U.S. Pat. No. 4,298,382 patent and the Liebermann article establish a method for consolidation of amorphous material into a bulk product by promoting material flow. For many magnetic applications it is preferred to consolidate amorphous ribbon to, or near the theoretical density while minimizing material flow which causes loss of identity of the individual ribbons.

SUMMARY OF INVENTION

A primary object of this invention is to produce bulk objects from metallic glass ribbons while maintaining the identity of the individual ribbons.

The method of the present invention for producing bulk objects can be summarized by the following steps: First, metallic glass ribbons are stacked in an overlapping relationship to form a bulk object composed of individual ribbons; and second, the bulk object is compacted under pressure at temperatures between about 70% to 90% of the absolute crystallization temperature ($T_x$) for a time sufficient to bond the individual ribbons.

For amorphous solids the crystallization temperature ($T_x$) is generally defined as the temperature at which the onset of crystallization occurs. $T_x$ can be determined using a differential scanning calorimeter as the point at which there is a change in sign of the slope of the heat capacity versus temperature curve.

Compaction of the bulk object can be done in an oxidizing atmosphere, such as air, while still maintaining the identity of the individual ribbons. It has been found that some dependent variation in time, pressure and/or temperature can be made. For example if a lower temperature is employed then either a longer time and/or higher pressure will be required to achieve bonding. In general it is preferred that a pressure of at least 1000 psi (6895 kPa) be applied to the bulk object during compaction.

BEST MODE FOR CARRYING THE INVENTION INTO PRACTICE

Narrow ribbon of ferromagnetic metallic glass can be cast by techniques such as jet casting which is described in the U.S. Pat. No. 4,298,382 patent. In general these ribbons will have a thickness of less than about 4 mils (101 microns), widths up to approximately 0.25 inches (0.635 cm), and can be produced in any desired length. When wider ribbons are desired a planar flow caster such as described in U.S. Pat. No. 4,142,571 may be employed.

It has been found that no special preparation of the ribbon surface need be made prior to compaction, and that ribbons with as cast surfaces can be compacted in accordance with the method of the present invention to form bulk objects.

Since no special preparation of the surface is required, such as the polishing step taught in the U.S. Pat. No. 4,298,382 patent, the method of the present invention may be done in a continuous process where multiple ribbons are preheated, brought into contact, and passed through rolling stands to compact the ribbon and continuously produce bulk objects.

Ribbon of metallic glass has been successfully compacted while maintaining the identity of the individual ribbons at temperatures between about 70 and 90% of the absolute crystallization temperature ($T_x$). The lower temperature limit provides bonding of the ribbons in a reasonable time, while the upper temperature limits assures that the material will maintain its amorphous state after compaction.

It is preferred that the temperature for compaction be between about 80 and 90% of $T_x$.

When bulk objects are produced by static hot pressing, to avoid shifting of the stacked ribbons it is preferred that the ribbons be either bundled and bound or pressed in a closed die. When the ribbons are bundled, a fiberglass tape, such as Scotch Brand #27 electrical tape, has been found effective in minimizing relative translation between ribbons during hot pressing.

It is further preferred that when the ribbons are hot pressed they be wrapped in a metal foil, such as stainless steel, to reduce the chance of the stacked ribbons sticking to the hot pressing die. When several different bulk objects are to be hot pressed in the same die, foil can be used to separate the objects and prevent the objects from sticking to each other as well as to prevent the objects from sticking to the die.

When ferromagnetic properties are desired for the bulk object any ferromagnetic amorphous material can be compacted by the technique described above. Compositions of typical ferromagnetic metallic glass materials that can be compacted using the method described above are found in U.S. Pat. No. 4,298,409.

In order to illustrate the invention the following examples are offered.

EXAMPLES 1-12

A series of ferromagnetic metallic glass ribbons made from an alloy having the nominal composition $Fe_{78}B_{13}Si_9$ (subscripts in atomic percent) were stacked and compacted by hot pressing in air at the pressures and temperatures set forth in Table 1. This alloy has a curie temperature of 415° C., and a crystallization temperature, $T_x$ of 542° C. For examples 1-12 the individual ribbons had a thickness of between 1 and 2 mils (25 and 50 microns). The ribbons were bundled together with Scotch Brand #27 electrical tape and wrapped in 2 mils (50 microns) stainless steel foil before hot pressing. The width, length and number of individual ribbons compacted to form the bulk objects are given in Table 1 respectively as w, l and #. The as consolidated properties of the compacted ribbon are reported in Table 2.

TABLE 1

| Sample Number | Dimensions width w | Dimensions length l | ribbons compacted # |
|---|---|---|---|
| 1 | 0.5" (1.2 cm) | 5" (12.7 cm) | 150 |
| 2 | 0.5 (1.2 cm) | 2.5" (6.35 cm) | 150 |
| 3 | 0.5 (1.2 cm) | 5" (12.7 cm) | 150 |
| 4 | 2" (5 cm) | 12" (30.5 cm) | 400 |
| 5 | 2" (5 cm) | 18" (45.7 cm) | 400 |
| 6 | 2" (5 cm) | 12" (30.5 cm) | 400 |
| 7 | 1" (2.5 cm) | 12" (30.5 cm) | 50 |
| 8 | 0.5" (1.2 cm) | 5.5" (14 cm) | 150 |
| 9 | 1" (2.5 cm) | 7" (17.8 cm) | 50 |
| 10 | 0.5" (1.2 cm) | 5.5" (14 cm) | 50 |
| 11 | 0.5" (1.2 cm) | 5.5" (14 cm) | 15 |
| 12 | 0.5" (1.2 cm) | 5.5" (14 cm) | 15 |

TABLE 2

| No. | Temp. °C. | Pressure ksi | Pressure mPa | Time Min. | Density | Bond | Percent crystalline |
|---|---|---|---|---|---|---|---|
| 1 | 392 | 40 | 277 | 10 | 90% | Good | 0.5% |
| 2 | 385 | 80 | 552 | 30 | 90% | Good | <0.5% |
| 3 | 451 | 40 | 277 | 30 | | Good | 17% |
| 4 | 419 | 4.6 | 22 | 960 | 86% | Good | 5% |
| 5 | 410 | 3 | 21 | 960 | 88.7% | Good | 5% |
| 6 | 390 | 2.3 | 16 | 960 | 88.9% | Good | <0.5% |
| 7 | 397 | 8.3 | 57 | 30 | | Fair | 0.5% |
| 8 | 369 | 40 | 277 | 70 | | Fair | <0.5% |
| 9 | 394 | 14 | 98 | 30 | | Fair | <0.5% |
| 10 | 325 | 40 | 277 | 30 | | Fair | <0.5% |
| 11 | 390 | 40 | 277 | 30 | | Good | 0.5% |
| 12 | 400 | 40 | 277 | 30 | | Good | 0.5% |

For the alloy used in the above examples there was no measurable glass transition temperature ($T_g$). The $T_g$ used in the work reported in the U.S. Pat. No. 4,298,382 patent is defined as the temperature at which a liquid transforms to an amorphous solid. The $T_g$ was measured using a differential scanning calorimeter, and is the temperature at the point of inflection of the heat capacity versus temperature curve. This point of inflection is more difficult to observe than the ($T_x$) which is the point of change in the sign of the slope of the heat capacity versus temperature curve. For this reason $T_x$ is preferred to $T_g$ as an index for determining the compaction temperature. There is usually less than 20° C. difference between the $T_x$ and $T_g$, and $T_x$ will be at the higher temperature.

As can be seen from examination of Table 1 there is a relationship between time, temperature, and pressure. Materials can be effectively consolidated at temperatures as high as approximately 450° C. It should be pointed out that if the lower estimated limit of $T_g$ discussed above is assumed (i.e. $T_g = T_x - 20°$ C.) then the highest pressing temperature is approximately 80° C. below $T_g$ for the examples.

Thus the temperatures employed to practice the present invention are substantially below the temperature taught and claimed in the U.S. Pat. No. 4,298,382 patent.

Table 2 describes the bonding associated with the examples. The bonding of the consolidated ribbon was considered "good" when there was not separation between the ribbons visable to the unaided eye. The bonding was considered "fair" when isolated regions of separation between some ribbons could be detected. These isolated regions of separation were in all cases less than 5% of the contact area between the ribbons.

The percent crystalline given in Table 2 represents the crystalline component of the consolidated ribbon that was determined by X-ray diffraction to be present after consolidation. By comparing examples 1, 11, 7 and 9 it can be seen that a pressure in excess of 14,000 psi (98,253 kPa) will be required to produce a good bond for time intervals of 30 minutes, at a pressing temperature of approximately 395° C. Comparing examples 6, 7 and 9 it can be seen that a pressing time longer than 30 minutes can be used to give a good bond at approximately 390° C. using a pressure of as low as 2,300 psi (15,900 kPa).

In order to improve the magnetic properties of the consolidated strip it was found necessary to give a post consolidation anneal. The anneal was done in an inert atmosphere of nitrogen. The optimum annealing temperature is above the pressing temperature, preferably above the Curie temperature, and below the crystallization temperature.

The magnetic properties of examples 11 and 12 of Table I were tested after the compacted bulk objects were annealed. The annealing cycle was:

(a) Heat to 450° C. at a rate of 10° C./min.
(b) Hold at 450° C. for 15 minutes.
(c) cool to ambient at a rate of 10° C./min.
(d) Heat to 380° C. at a rate of 2° C./min in a 10 oe field.
(e) Hold at 380° C. for 60 minutes with field.
(f) Cool to ambient at a rate of approximately 2° C./min.

The magnetic properties of the samples annealed in accordance with the above cycle are reported in Table 3. The power losses and the excitation values were measured at 1.4 Tesla (T).

TABLE 3

| No. | Form | Core Loss watts/kg at 1.4 T | Core Loss VA/kg at 1.4 T |
|---|---|---|---|
| 11 | compacted ribbon | 0.343 | 0.380 |
| 12 | compacted ribbon | 0.250 | 0.339 |
| | ribbon | 0.138 | 0.542 |

As can be seen from Table 3 the magnetic properties of the consolidated metallic glass ribbon approached the magnetic properties of annealed amorphous ribbon. It should be pointed out that the core losses of there materials are substantially less than the core losses for fine grain oriented materials which typically have core losses of approximately 1 watt/kg at 1.4 T.

What we claim is:

1. A method for making bulk objects from metallic glass ribbons while maintaining the physical identity of the individual ribbons comprising:

stacking the ribbons in an overlapping aligned relationship; and compacting at a pressure of at least 1000 psi (6895 kPa) at a temperature between about 70 and 90% of the crystallization temperature for a time sufficient to bond the ribbons.

2. The method of claim 1 wherein the temperature is further restricted to 85 to 90% of the crystallization temperature and said compacting is done in an oxidizing atmosphere.

3. The method of claim 2 wherein said compaction pressure is applied by a roll stand with the ribbons raised to said temperature before entry into said roll stand.

4. The method of claim 2 wherein said compaction is accomplished by hot pressing and the ribbons segmented with said segments placed in overlapping relationship.

5. The method of claim 4 wherein said segments placed in overlapping relationship are bundled.

6. The method of claim 4 wherein said stacked strips are wrapped in foil before consolidation.

7. The method of claim 3 or 5 wherein the consolidated ribbon is given an anneal at a temperature up to 100° C. above the pressing temperature.

8. The consolidated product made by the process of claim 3 or 5.

* * * * *